US010069217B2

(12) United States Patent
Hamada

(10) Patent No.: US 10,069,217 B2
(45) Date of Patent: Sep. 4, 2018

(54) TERMINAL AND WIRE WITH TERMINAL

(71) Applicant: Sumitomo Wiring Systems, Ltd., Yokkaichi, Mie (JP)

(72) Inventor: Hiroshi Hamada, Mie (JP)

(73) Assignee: SUMITOMO WIRING SYSTEMS, LTD., Yokkaichi, mie (JP)

( * ) Notice: Subject to any disclaimer, the term of this patent is extended or adjusted under 35 U.S.C. 154(b) by 0 days.

(21) Appl. No.: 15/551,405

(22) PCT Filed: Feb. 16, 2016

(86) PCT No.: PCT/JP2016/054371

§ 371 (c)(1),
(2) Date: Aug. 16, 2017

(87) PCT Pub. No.: WO2016/143468

PCT Pub. Date: Sep. 15, 2016

(65) Prior Publication Data

US 2018/0034167 A1 Feb. 1, 2018

(30) Foreign Application Priority Data

Mar. 6, 2015 (JP) ..... 2015-044755

(51) Int. Cl.

| | |
|---|---|
| ***H01R 4/18*** | (2006.01) |
| *H01R 24/20* | (2011.01) |
| *H01R 13/415* | (2006.01) |
| *H01R 4/20* | (2006.01) |

(52) U.S. Cl.

CPC ..... *H01R 4/185* (2013.01); *H01R 4/20* (2013.01); *H01R 13/415* (2013.01); *H01R 24/20* (2013.01)

(58) Field of Classification Search

CPC ..... H01R 13/415; H01R 4/20; H01R 24/20
USPC ..... 439/865, 866, 867, 870, 877
See application file for complete search history.

(56) References Cited

U.S. PATENT DOCUMENTS

| | | | | |
|---|---|---|---|---|
| 2,983,898 | A | 10/1957 | Kalmar et al. | |
| 5,158,485 | A | 10/1992 | Saito et al. | |
| 2015/0079857 | A1* | 3/2015 | Kawamura ..... | H01R 43/0482 439/877 |

(Continued)

FOREIGN PATENT DOCUMENTS

| | | |
|---|---|---|
| JP | 7-36364 | 7/1995 |
| JP | 2009-21148 | 1/2009 |
| JP | 2014-164826 | 9/2014 |

OTHER PUBLICATIONS

International Search Report dated May 10, 2016.

*Primary Examiner* — Tho D Ta
*Assistant Examiner* — Marcus Harcum
(74) *Attorney, Agent, or Firm* — Gerald E. Hespos; Michael J. Porco; Matthew T. Hespos

(57) ABSTRACT

A terminal 20 disclosed by this specification is crimped to a wire 30, in which a core 31 is covered with an insulation coating 32, with the wire 30 pulled out rearward, and includes a core crimping portion 40 to be crimped to the core 31 and a coating crimping portion 50 to be crimped to the insulation coating 32. The coating crimping portion 50 in a state crimped to the insulation coating 32 includes flat portions 55 extending flat in a pull-out direction of the wire 30 and a projection 52 projecting more toward the core 31 than the flat portions 55 and having a projecting amount increased toward a rear side.

4 Claims, 5 Drawing Sheets

(56) References Cited

U.S. PATENT DOCUMENTS

2016/0020528 A1* 1/2016 Miyakawa ..... H01R 13/111
439/870

* cited by examiner

TERMINAL AND WIRE WITH TERMINAL

BACKGROUND

1. Field of the Invention

This specification relates to a terminal and a wire with terminal.

2. Description of the Related Art

Japanese Utility Model Application No. H07-36364 discloses a terminal connected to a wire. The terminal includes a barrel to be crimped to the wire, and the barrel is formed with through holes. The terminal is crimped to the wire by fastening the barrel so that a folded part of a conductor is pressed into contact with a bottom part of the terminal by an insulation coating.

In the above configuration, if a cross-sectional area of the conductor becomes smaller, a force for holding the conductor is reduced and a force exerted to the insulation coating gradually increases when the wire is pulled. Then, edge parts of the through holes of the barrel easily bite into the insulation coating to tear the insulation coating. Although the barrel is crimped to the insulation coating in this way, the crimping of the insulation coating does not contribute to an improvement in the impact resistance of the wire at all and the insulation coating could not compensate for a reduction of the conductor holding force.

SUMMARY

A terminal disclosed by this specification is to be crimped to a wire that is pulled out rearward from the terminal. The wire has a core covered with an insulation coating. The terminal includes a core crimping portion to be crimped to the core, and a coating crimping portion to be crimped to the insulation coating. The coating crimping portion that has been crimped to the insulation coating includes a flat portion extending flat in a pull-out direction of the wire and a projection projecting more toward the core than the flat portion. A projecting amount of the projection is increased toward a rear side.

This specification also relates to a combination of the above-described terminal that has been crimped to the wire as described above.

According to these configurations, the projection can compress the insulation coating at a higher rate than the flat portion. Here, if the wire is pulled rearward, the insulation coating compressed on a front end of the projection is reduced in diameter toward a rear end. When the compression of the insulation coating reaches a limit and the insulation coating cannot be compressed any further. Thus, the wire cannot pass through the rear end of the projection and is retained. In addition, the insulation coating is hardened by receiving a high compressive stress so that the rigidity thereof is increased locally and a state where the insulation coating is caught at the rear end of the projection can be maintained. Thus, a holding force of the wire can be enhanced using the insulation coating.

As just described, the rigidity of the insulation coating is enhanced by a high compressive stress instead of causing edge parts to bite into the insulation coating and to catch the insulation coating as before. Thus, the insulation coating easily retains its shape without being deformed in response to the pulling of the wire, and the insulation coating is difficult to cut. Therefore, the impact strength of the wire can be improved by crimping the coating crimping portion to the insulation coating.

The projection may have a tapered compressing surface approaching the core toward the rear and a perpendicular surface provided on a rear end of the compressing surface. The perpendicular surface is connected to the flat portion at an angle closer to a right angle than the compressing surface. According to this configuration, when the wire is pulled rearward, the insulation coating easily slides along the tapered compressing surface and can be compressed smoothly. Further, when the insulation coating is compressed by the compressing surface, a reaction force from the insulation coating can be received by the perpendicular surface. Thus, the projection will not deform.

The coating crimping portion may be composed of a bottom wall and two coating crimping pieces projecting from opposite sides of the bottom wall. The projection may be in the form of a single rib in an area extending from one of the coating crimping pieces to the other coating crimping piece across the bottom wall. According to this configuration, the projection compresses the insulation coating continuously in a wide range.

According to the specification, it is possible to improve the impact strength of a wire using an insulation coating when the wire is pulled.

DETAILED DESCRIPTION

Figure 1:
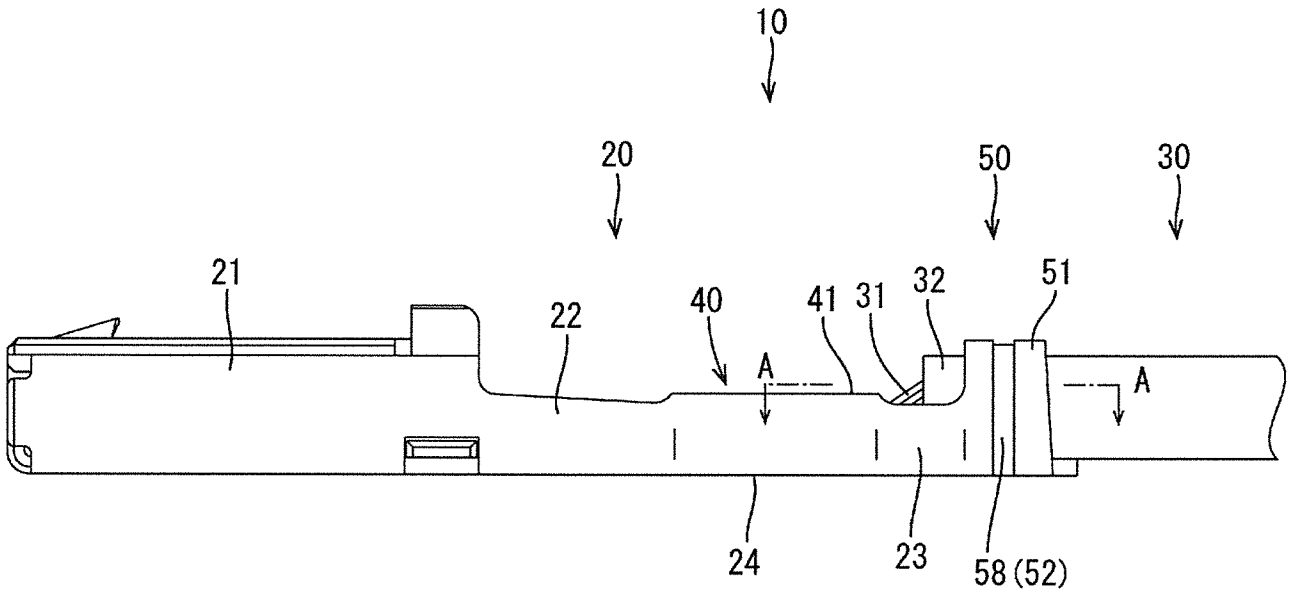
FIG. 1 is a side view of a wire with terminal.

An embodiment is described with reference to FIGS. 1 to 6. A wire with terminal 10 of this embodiment includes a terminal 20 and a wire 30 as shown in FIG. 1. The wire 30 is composed of a core 31 formed by twisting conductive metal strands and an insulation coating 32 made of synthetic resin and covering the core 31. The insulation coating 32 is stripped at a front end part of the wire 30 to expose the core 31, and the wire 30 and the terminal 20 are connected conductively by crimping the terminal 20 to the exposed core 31. In this way, the wire 30 is pulled out rearward from the terminal 20.

Figure 3:
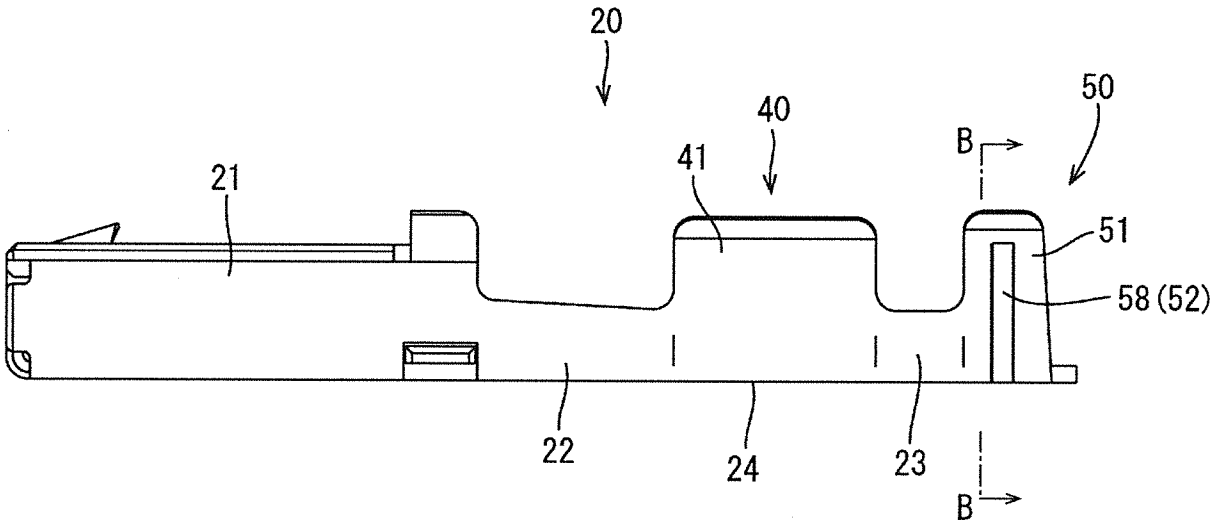
FIG. 3 is a side view of a terminal.

As shown in FIG. 3, the terminal 20 of this embodiment is a female terminal and includes a box-shaped terminal connecting portion 21 to be connected to a mating male terminal, a core crimping portion 40 to be crimped to the core 31 of the wire 30 and a coating crimping portion 50 to be crimped to the insulation coating 32 of the wire 30. Further, a front linking portion 22 couples the terminal connecting portion 21 to the core crimping portion 40, and a rear linking portion 23 couples the core crimping portion 40 to the coating crimping portion 50. Each linking portion 22, 23 is substantially U-shaped and is open up. Further, the terminal 20 is provided with a bottom wall 24 common to the terminal connecting portion 21, the front linking portion 22, the core crimping portion 40, the rear linking portion 23 and the coating crimping portion 50.

Figure 4:
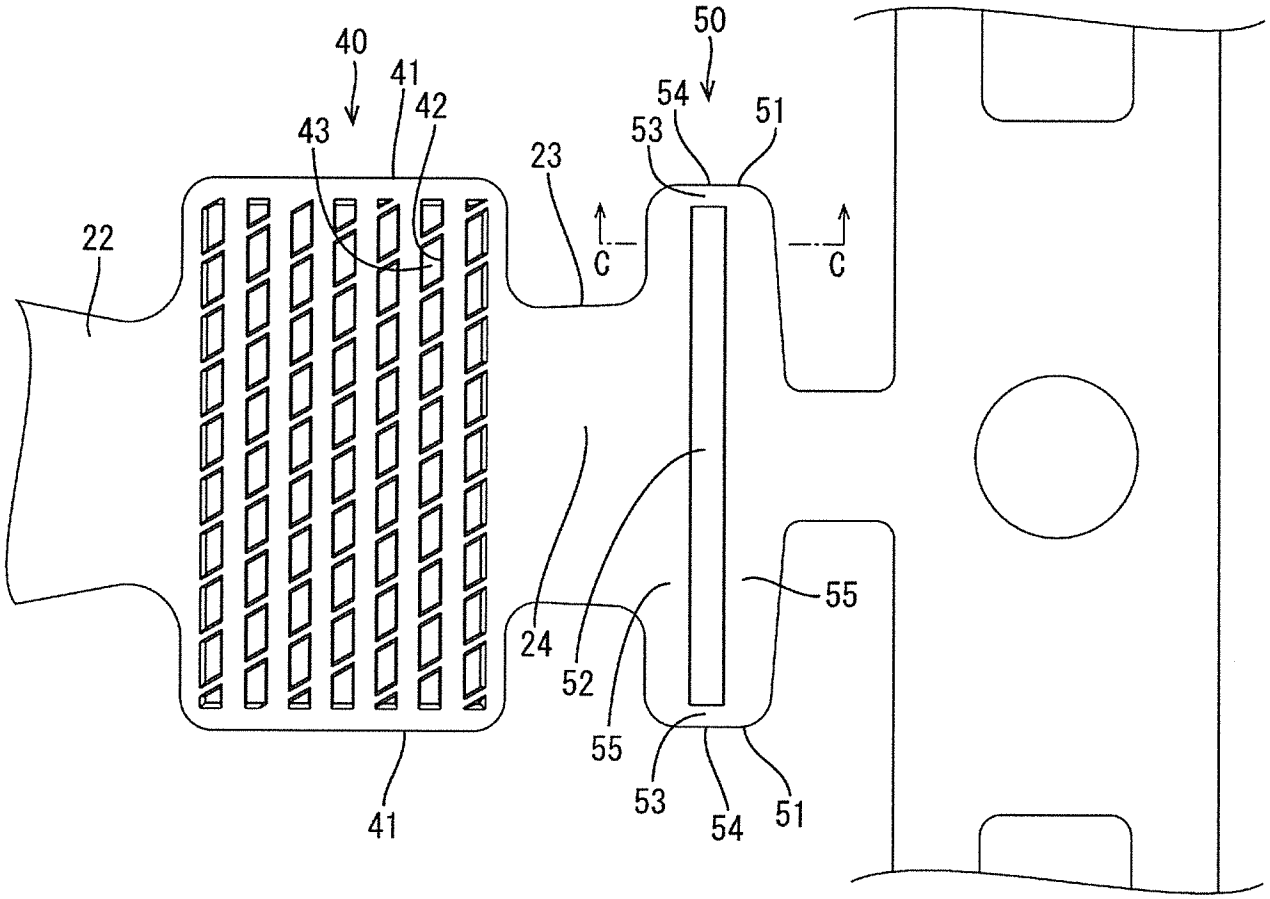
FIG. 4 is a plan view of a crimping portion in an expanded state.

The core crimping portion 40 is composed of the bottom wall 24 and two core crimping pieces 41 that project up from opposite sides of the bottom wall 24. Further, the core crimping portion 40 is substantially U-shaped and the core crimping pieces 41 are arranged to face each other. Lower parts of the core crimping pieces 41 are coupled to side walls of the front linking portion 22 and side walls of the rear linking portion 23. Further, as shown in FIG. 4, a crimping surface of the core crimping portion 40 is knurled to form a serration 42.

The serration 42 is constituted by recesses 43 having a parallelogram shape. When the core crimping pieces 41 are crimped to the core 31, the recesses 43 are arranged along an axial direction of the respective metal strands of the core 31 and edges on long sides of the respective recesses 43 bite into the core 31 so that a high holding force is exhibited. Further, if the core 31 is made of aluminum, the edges on the long sides of the recesses 43 break through a nonconductive oxide coating and the like formed on the surface of the core 31 and are connected conductively to a conductive aluminum layer hidden below the oxide coating and the like.

The coating crimping portion 50 is composed of the bottom wall 24 and two coating crimping pieces 51 that project up from both side edges of the bottom wall 24. Further, the coating crimping portion 50 is substantially U-shaped and the coating crimping pieces 51 are arranged to face each other. Lower parts of the coating crimping pieces 51 are coupled to the side walls of the rear linking portion 23.

Figure 5:
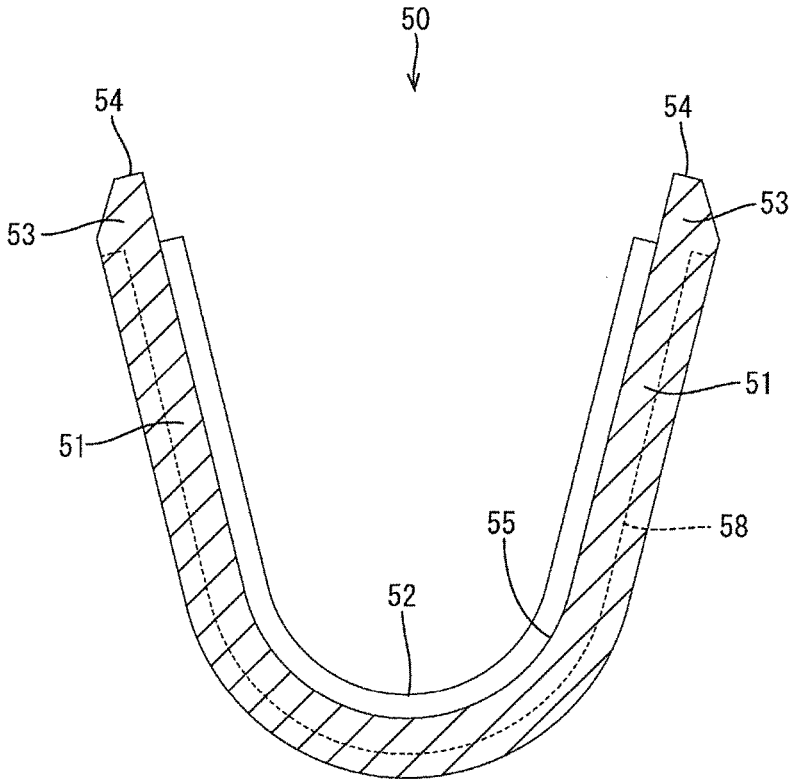
FIG. 5 is a section along B-B in FIG. 3.

A single rib-like projection 52 projects on a crimping surface of the coating crimping portion 50. The projection 52 is provided in an area extending from a projecting end part 53 of one coating crimping piece 51 to a projecting end part 53 of the other coating crimping piece 51 across the bottom wall 24, but both end parts of the projection 52 do not reach outer edges 54 of the coating crimping pieces 51 in this area, as shown in FIG. 5.

Figure 2:
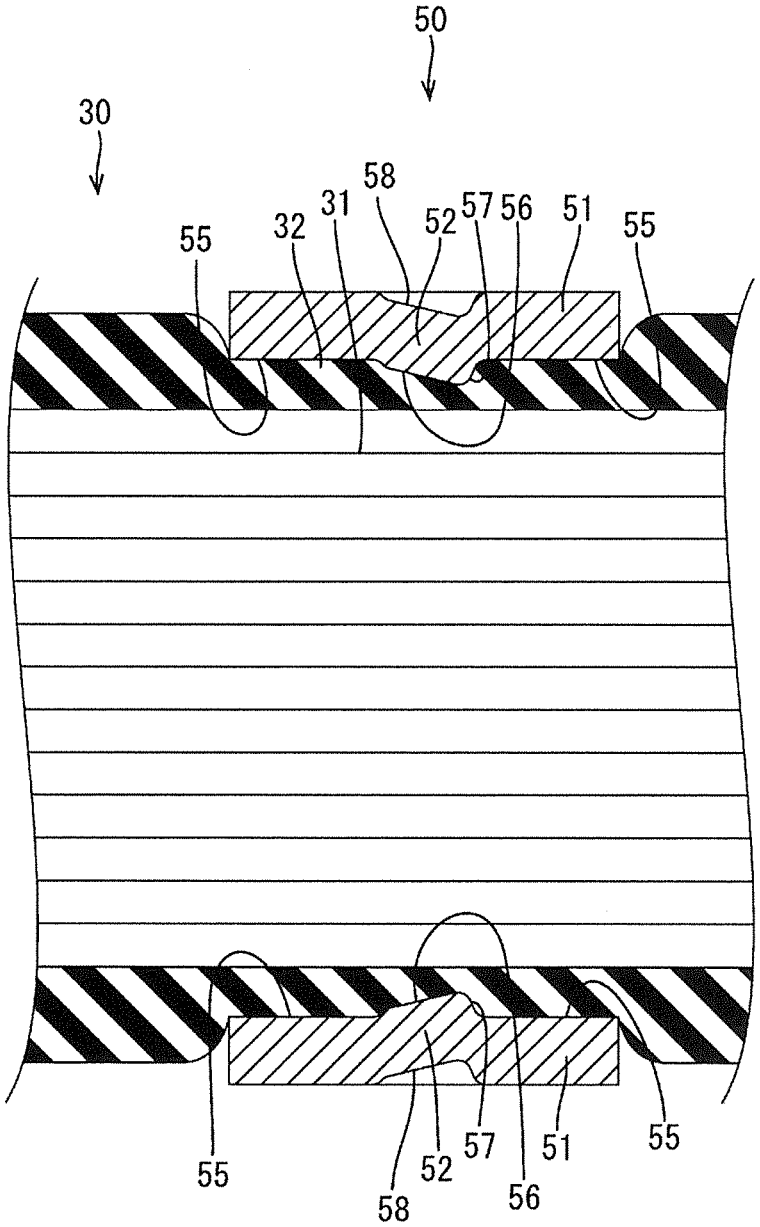
FIG. 2 is a section along A-A in FIG. 1.

As shown in FIG. 2, the coating crimping portion 50 in a state crimped to the insulation coating 32 includes front and rear flat portions 55 extending flat in a pull-out direction of the wire 30. The projection 52 projects more toward the core 31 than these flat portions 55 and has a projecting amount increased toward a rear side. That is, the two flat portions 55 are disposed respectively on front and rear sides of the coating crimping portion 50, and the projection 52 is disposed between these flat portions 55. The flat portions 55 are coupled to each other at the projecting end parts 53 of the coating crimping pieces 51.

Figure 6:
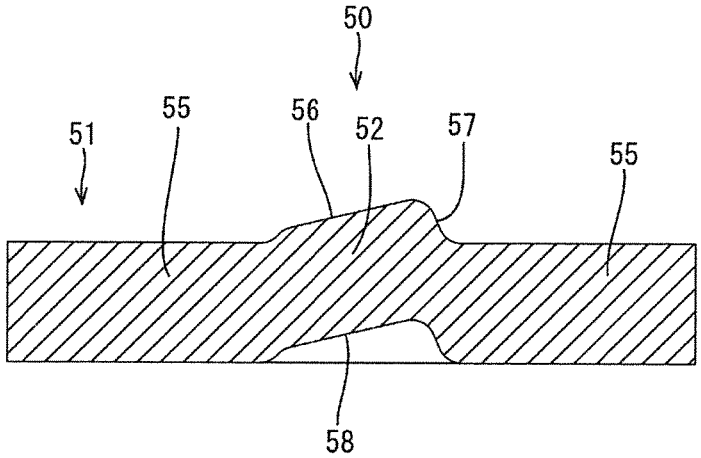
FIG. 6 is a section along C-C in FIG. 4.

As shown in FIG. 2, the projection 52 is formed by striking the coating crimping portion 50 toward the core 31. Thus, a recess 58 is formed on a surface of the projection 52 opposite to the crimping surface so that a plate thickness of the projection 52 is substantially constant at all positions in a front-rear direction. As shown in FIG. 6, the projection 52 has a tapered compressing surface 56 approaching the core 31 toward the rear. A perpendicular surface 57 is provided on the rear end of this compressing surface 56 and is connected to the flat portion 55 at an angle closer to a right angle than the compressing surface 56.

This embodiment is configured as described above and functions thereof are described next. First, a method for manufacturing the wire with terminal 10 is described briefly. The insulation coating 32 is stripped on the end part of the wire 30 to expose the core 31. Subsequently, the core 31 is placed on the bottom wall 24 of the core crimping portion 40 of the terminal 20 and the insulation coating 32 adjacent to the core 31 is placed on the bottom wall 24 of the coating crimping portion 50. In this state, the both crimping portions 40, 50 are sandwiched vertically and crimped by an unillustrated crimping machine, the two core crimping pieces 41 are crimped to the core 31 and the two coating crimping pieces 51 are crimped to the insulation coating 32. In this way, the core 31 is fixed to the core crimping portion 40 and the insulation coating 32 is fixed to the coating crimping portion 50. Specifically, as shown in FIG. 2, the coating crimping portion 50 is crimped to the insulation coating 32 normally (low compression) by the flat portions 55 of the coating crimping pieces 51 and more firmly than normal (high compression) by the projection 52.

Next, a case where the wire 30 is pulled rearward is described briefly. Note that since the same functions and effects are exhibited also when the terminal 20 is pulled forward, repeated description is omitted. When the wire 30 is pulled rearward, the insulation coating 32 located on a front end of the projection 52 is compressed toward the core 31 while moving rearward along the compressing surface 56. As the insulation coating 32 is compressed further and reaches a limit, the insulation coating 32 enters, on a rear end of the projection 52, a state where the insulation coating 32 cannot be compressed any further. In this way, the insulation coating 32 is hardened by receiving a high compressive stress, the rigidity thereof is locally increased, and this part with high rigidity is caught firmly by the rear end of the projection 52. In this state, the insulation coating 32 is not easily deformed even if receiving a strong reaction force from the rear end of the projection 52 so that the insulation coating 32 can withstand the pulling of the wire 30.

Specifically, the insulation coating 32 is softer and easier to cut than the core 31. Thus, if edges of the serration 42 of the core crimping portion 40 are caused to bite into the core 31, the insulation coating 32 is torn easily and this configuration cannot contribute to an improvement in the holding force of the wire 30. On the other hand, this embodiment locally increases the rigidity of the insulation coating 32 by applying a compressive stress to the insulation coating 32. Thus, the insulation coating 32 is hardened and becomes difficult to cut. Thus, the insulation coating 32 can withstand the pulling of the wire 30.

As described above, the wire with terminal 10 of this embodiment includes the wire 30 in which the core 31 is covered with the insulation coating 32, and the terminal 20 to be crimped to this wire 30. The wire 30 is pulled out rearward from the terminal 20. The terminal 20 includes the core crimping portion 40 to be crimped to the core 31 and the coating crimping portion 50 to be crimped to the insulation coating 32. The coating crimping portion 50 that has been crimped to the insulation coating 32 includes the flat portions 55 extending flat in the pull-out direction of the wire 30 and the projection 52 projecting more toward the core 31 than the flat portions 55. The projecting amount of the projection 52 is increased toward the rear.

According to this configuration, the projection 52 can compress the insulation coating 32 at a higher rate than the flat portions 55. If the wire 30 is pulled rearward, the insulation coating 32 is compressed on the front end of the projection 52 is reduced in diameter toward the rear. The compression of the insulation coating 32 eventually reaches a limit where the insulation coating 32 cannot be compressed any further. At this point, the wire 30 cannot pass through the rear end of the projection 52 and is retained. In addition, the high compressive stress increases the rigidity of the insulation coating locally and a state where the insulation coating 32 is caught at the rear end side of the projection 52 can be maintained. Thus, the holding force of the wire 30 can be enhanced using the insulation coating 32.

As just described, the rigidity of the insulation coating 32 is enhanced by a high compressive stress instead of causing edges to bite into the insulation coating 32 and to catch the insulation coating 32 as before. Thus, the insulation coating 32 easily retains shape without being deformed in response to the pulling of the wire 30, and the insulation coating 32 is difficult to cut. Therefore, the impact strength of the wire 30 can be improved by crimping the coating crimping portion 50 to the insulation coating 32.

Further, the projection 52 may have the tapered compressing surface 56 approaching the core 31 toward the rear and the perpendicular surface 57 provided on the rear end of this compressing surface 56 and connected to the flat portion 55 at an angle closer to a right angle than the compressing surface 56. According to this configuration, when the wire 30 is pulled rearward, the insulation coating 32 easily slides along the tapered compressing surface 56 and can be compressed smoothly. Further, when the insulation coating 32 is compressed by the compressing surface 56, a reaction force from the insulation coating 32 can be received by the perpendicular surface 57. Thus, the deformation of the projection 52 can be avoided.

The coating crimping portion 50 may be composed of the bottom wall 24 and the coating crimping pieces 51 projecting from the both side edges of the bottom wall 24, and the projection 52 may be in the form of a single rib in the area extending from one coating crimping piece 51 to the other coating crimping piece 51 across the bottom wall 24. According to this configuration, the insulation coating 32 can be compressed continuously in a wide range by the projection 52.

The invention is not limited to the above described and illustrated embodiment. For example, the following various modes are also included.

The projection 52 is formed by striking the coating crimping portion 50 in the above embodiment. However, the projection may be formed by a processing method (e.g. cutting and raising) other than striking or a projection separate from flat portions may be assembled with the flat portions in a separate process.

The tapered compressing surface 56 is illustrated in the above embodiment. However, the shape of the compressing surface may be other than a tapered shape or the compressing surface may project into a moderate arc shape or may be recessed into a moderately curved shape.

The perpendicular surface 57 connected to the flat portion 55 at an angle closer to a right angle than the compressing surface 56 is illustrated in the above embodiment. However, a tapered inclined surface symmetric with the compressing surface 56 may be provided instead of the perpendicular surface 57. In this case, a cross-sectional shape of the coating crimping portion 50 is a bilaterally symmetrical chevron shape.

Although the projection 52 in the form of a single rib is illustrated in the above embodiment, a plurality of projections may be provided side by side in a circumferential direction.

LIST OF REFERENCE SIGNS

10 . . . wire with terminal
20 . . . terminal
24 . . . bottom wall
30 . . . wire
31 . . . core
32 . . . insulation coating
40 . . . core crimping portion
50 . . . coating crimping portion
51 . . . coating crimping piece
52 . . . projection
53 . . . projecting end part
55 . . . flat portion
56 . . . compressing surface
57 . . . perpendicular surface

The invention claimed is:

1. A terminal to be crimped to a wire, in which a core is covered with an insulation coating, with the wire pulled out rearward, comprising:

a core crimping portion to be crimped to the core; and a coating crimping portion to be crimped to the insulation coating;

wherein:

the coating crimping portion in a state crimped to the insulation coating includes a flat portion extending flat in a pull-out direction of the wire and a projection projecting more toward the core than the flat portion and having a projecting amount increased toward a rear side; and the projection has a tapered compressing surface approaching the core toward the rear side and defining a first angle with respect to the flat portion, the compressing surface having a rear end, the projection further having a perpendicular surface extending from the flat portion to the rear end of the compressing surface and connected to the flat portion at a second angle closer to a right angle than the first angle.

2. A wire with terminal including a wire, in which a core is covered with an insulation coating, and a terminal to be crimped to the wire, wherein:

the wire is pulled out rearward from the terminal;

the terminal includes a core crimping portion to be crimped to the core and a coating crimping portion to be crimped to the insulation coating; and the coating crimping portion in a state crimped to the insulation coating includes a flat portion extending flat in a pull-out direction of the wire and a projection projecting more toward the core than the flat portion and having a projecting amount increased toward a rear side; and the projection has a tapered compressing surface approaching the core toward the rear side and defining a first angle with respect to the flat portion, the compressing surface having a rear end, the projection further having a perpendicular surface extending from the flat portion to the rear end of the compressing surface and connected to the flat portion at a second angle closer to a right angle than the second angle.

3. The wire with terminal of claim 2, wherein:

the coating crimping portion is composed of a bottom wall having opposite first and second sides and first and second coating crimping pieces to projecting respectively from the first and second sides of the bottom wall, and the projection is in the form of a single rib in an area extending from the first coating crimping pieces to the second coating crimping piece across the bottom wall.

4. A terminal to be crimped to a wire, in which a core is covered with an insulation coating, with the wire pulled out rearward, comprising:

a core crimping portion to be crimped to the core; and a coating crimping portion to be crimped to the insulation coating, the coating crimping portion being composed of a bottom wall having opposite first and second sides and first and second coating crimping pieces projecting respectively from the first and second sides of the bottom wall, the coating crimping portion, in a state crimped to the insulation coating, including a flat portion extending flat in a pull-out direction of the wire and a projection in the form of a single rib in an area extending from the first coating crimping piece to the second coating crimping piece across the bottom wall, the projection projecting more toward the core than the flat portion, the projection having a tapered compressing surface approaching the core more toward a rear side and defining a first angle with respect to the flat portion, the compressing surface having a rear end, the projection further having a perpendicular surface extending from the flat portion to the rear end of the compressing surface and connected to the flat portion at a second angle closer to a right angle than the first angle.

* * * * *